US008926362B2

(12) United States Patent
Xu et al.

(10) Patent No.: US 8,926,362 B2
(45) Date of Patent: Jan. 6, 2015

(54) POWER ADAPTOR

(71) Applicant: Changzhou Amphenol Fuyang Communication Equip. Co., Ltd., Wujin, Changzhou, Jiangsu (CN)

(72) Inventors: Yiming Xu, Changzhou (CN); Tingxing Sheng, Changzhou (CN)

(73) Assignee: Changzhou Amphenol Fuyang Communication Equip. Co., Ltd., Changzhou (CN)

( * ) Notice: Subject to any disclaimer, the term of this patent is extended or adjusted under 35 U.S.C. 154(b) by 36 days.

(21) Appl. No.: 13/934,582

(22) Filed: Jul. 3, 2013

(65) Prior Publication Data

US 2014/0011384 A1 Jan. 9, 2014

(30) Foreign Application Priority Data

Jul. 4, 2012 (CN) ..... 2012 2 0320367 U
Jul. 4, 2012 (CN) ..... 2012 2 0320383 U

(51) Int. Cl.

| | |
|---|---|
| ***H01R 9/05*** | (2006.01) |
| ***H01R 13/62*** | (2006.01) |
| ***H01R 4/36*** | (2006.01) |
| ***H01R 24/38*** | (2011.01) |
| *H01R 13/58* | (2006.01) |
| *H01R 13/622* | (2006.01) |

(52) U.S. Cl.

CPC ..... *H01R 13/62* (2013.01); *H01R 4/36* (2013.01); *H01R 24/38* (2013.01); *H01R 13/5812* (2013.01); *H01R 13/622* (2013.01); *H01R 2201/02* (2013.01); *Y10S 439/907* (2013.01)

USPC ..... 439/583; 439/907

(58) Field of Classification Search

USPC ..... 439/583, 907, 578, 810, 814

See application file for complete search history.

(56) References Cited

U.S. PATENT DOCUMENTS

| | | | | |
|---|---|---|---|---|
| 4,518,217 | A * | 5/1985 | Corrigan, III | 439/668 |
| 6,159,046 | A * | 12/2000 | Wong | 439/578 |
| 6,558,194 | B2 | 5/2003 | Montena | |
| 6,676,446 | B2 | 1/2004 | Montena | |
| 6,848,940 | B2 | 2/2005 | Montena | |
| 6,943,298 | B2 * | 9/2005 | Nicholson | 174/74 R |
| 7,070,447 | B1 | 7/2006 | Montena | |
| 7,156,696 | B1 | 1/2007 | Montena | |
| 7,189,115 | B1 | 3/2007 | Montena | |
| 7,311,554 | B1 | 12/2007 | Jackson et al. | |
| 7,357,672 | B2 | 4/2008 | Montena | |
| 7,374,455 | B2 | 5/2008 | Purdy et al. | |

(Continued)

*Primary Examiner* — Phuong Dinh
(74) *Attorney, Agent, or Firm* — Blank Rome LLP

(57) ABSTRACT

An electrical connector comprising a threaded sleeve for mating with another electrical component, a connector body which has first and second ends and a central axis, the first end receiving the threaded sleeve and the second end having a blind hole extending through the connector body, an insulator positioned within the connector body, a contact pin positioned within the insulator having an axial center line, an extension extending from the second end of the connector body along its central axis, the extension extending coaxially with the contact pin and which has a primary cable clamp, a fastener positioned within the connector body, and a secondary cable clamp coupled to the second end of the connector body via the blind hole, wherein the blind hole is adjacent to the extension and the axis of the blind hole is parallel with the axial center line of the contact pin, such that the fastener passes through the connector body such that at least a portion is receivable in the blind hole is provided.

23 Claims, 5 Drawing Sheets

(56) References Cited

U.S. PATENT DOCUMENTS

| | | | | |
|---|---|---|---|---|
| 7,431,614 | B2 | 10/2008 | Eriksen | |
| 7,458,851 | B2 | 12/2008 | Montena | |
| 7,908,741 | B2 | 3/2011 | Chawgo | |
| 7,993,159 | B2 | 8/2011 | Chawgo | |
| 8,007,314 | B2 | 8/2011 | Chawgo et al. | |
| 8,123,557 | B2 | 2/2012 | Montena et al. | |
| 8,177,583 | B2 | 5/2012 | Chawgo et al. | |
| 2008/0261447 | A1* | 10/2008 | D'Addario et al. | 439/583 |
| 2011/0217871 | A1* | 9/2011 | Benham et al. | 439/583 |
| 2011/0312210 | A1 | 12/2011 | Chawgo et al. | |

* cited by examiner

POWER ADAPTOR

RELATED APPLICATIONS

The present application claims priority under 35 U.S.C. §119 to Chinese Patent Application Nos. 201220320383.7 and 201220320367.8, both filed Jul. 4, 2012, the entire disclosures of which are incorporated herein by reference.

FIELD OF THE INVENTION

The present application relates to an electrical connector, such as a power adaptor. Specifically, the electrical connector is used to connect a power cable and an antenna feeder in a mobile communication network.

BACKGROUND OF THE INVENTION

Along with the development of the fourth generation of mobile technologies, modern mobile communication base stations are tending to be smaller and set outdoors, and optical cables and power cables are gradually being used to replace the primary antenna feeder component. Conventional Radio Remote Units (RRUs), which use an optical power composite cable to send signals directly to the base station, are costly. However, the cost of adding a cable to the primary antenna feeder is relatively low. In order to connect the primary antenna feeder with an added power cable, an electrical connector, such as a power adaptor, is needed.

SUMMARY OF THE INVENTION

Accordingly, the present invention provides an electrical connector comprising a threaded sleeve for mating with another electrical component, a connector body which has first and second ends and a central axis, the first end receives the threaded sleeve and the second end has a blind hole extending through the connector body, an insulator positioned within the connector body, a contact pin positioned within the insulator and which as an axial center line, an extension extending from the second end of the connector body along its central axis, the extension extending coaxially with the contact pin and which has a primary cable clamp, a fastener positioned within the connector body, and a secondary cable clamp coupled to the second end of the connector body via the blind hole, wherein the blind hole is adjacent to the extension and the axis of the blind hole is substantially parallel with the axial center line of the contact pin, such that the fastener passes through the connector body such that at least a portion is receivable in the blind hole.

The present invention also provides an electric connector comprising a threaded sleeve for mating with another electrical component, a connector body which has first and second ends, the first end receives the threaded sleeve and the second end has a hollow extension extending therefrom and a blind hole extending through the connector body, the blind hole adjacent to the hollow extension, an insulator positioned within the connector body, a contact pin positioned within the insulator and which has an axial center line, a primary cable clamp coupled to the hollow extension of the connector body, a fastening piece positioned within the primary cable clamp extending axially therewith, a secondary cable clamp coupled to the second end of the connector body via the blind hole, and a fastener positioned within the connector body, wherein the axis of the blind hole is substantially parallel with the axial center line of the contact pin, such that the fastener passes through the connector body such that at least a portion is receivable in the blind hole.

The invention also provides an electrical connector comprising a threaded sleeve for mating with another electrical component, a connector body which has first and second ends and a central axis, the first end receives the threaded sleeve and the second end has a blind hole extending through the connector body, an insulator positioned within the connector body, a contact pin positioned within the insulator and which has an axial center line, a primary cable clamp coupled to the second end of the connector body, a fastener positioned within the connector body, and a secondary cable clamp coupled to the second end of the connector body via the blind hole, wherein the axis of the blind hole is substantially parallel with the axial center line of the contact pin, such that the fastener passes through the connector body such that at least a portion is receivable in the blind hole.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 4:
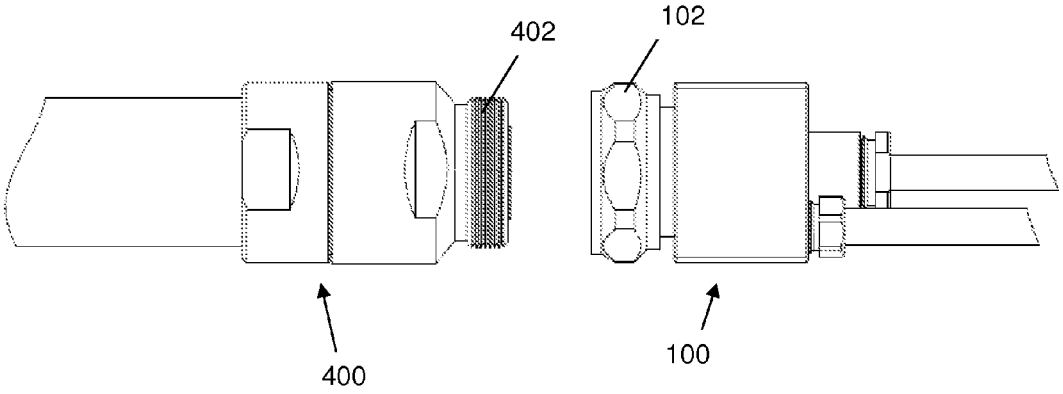
FIG. 4 is an exploded elevational view of an electrical connector according to an exemplary embodiment of the present invention, showing the connector being coupled to an antenna feeder connector.

Referring to FIGS. 1, 2A-2D and 4, an electrical connector 100 according to an exemplary embodiment of the present invention, generally includes a threaded sleeve 102, a connector body 104, an insulator 106 positioned within the connector body 104, a contact pin 108 positioned within the insulator 106, and primary and secondary cable clamps 122 and 112 The electrical connector 100 is preferably a power adaptor used to connect power cables to an antenna feeder connector 400 in a mobile communication network, as seen in FIG. 4.

Figure 1:
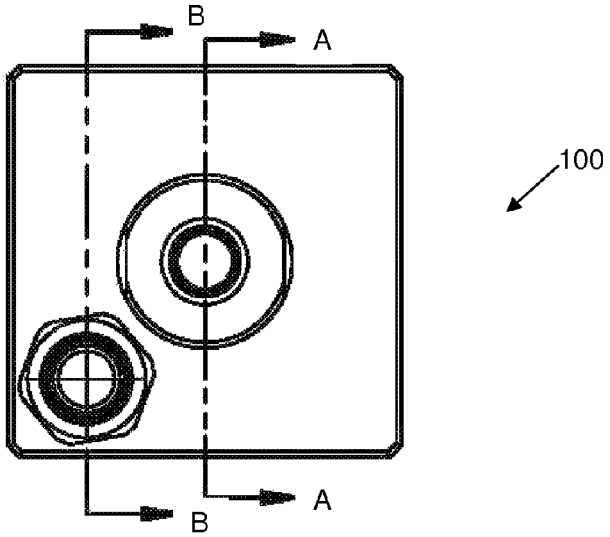
FIG. 1 is a front elevational view of an electrical connector according to an exemplary embodiment of the present invention.
Figure 2A:
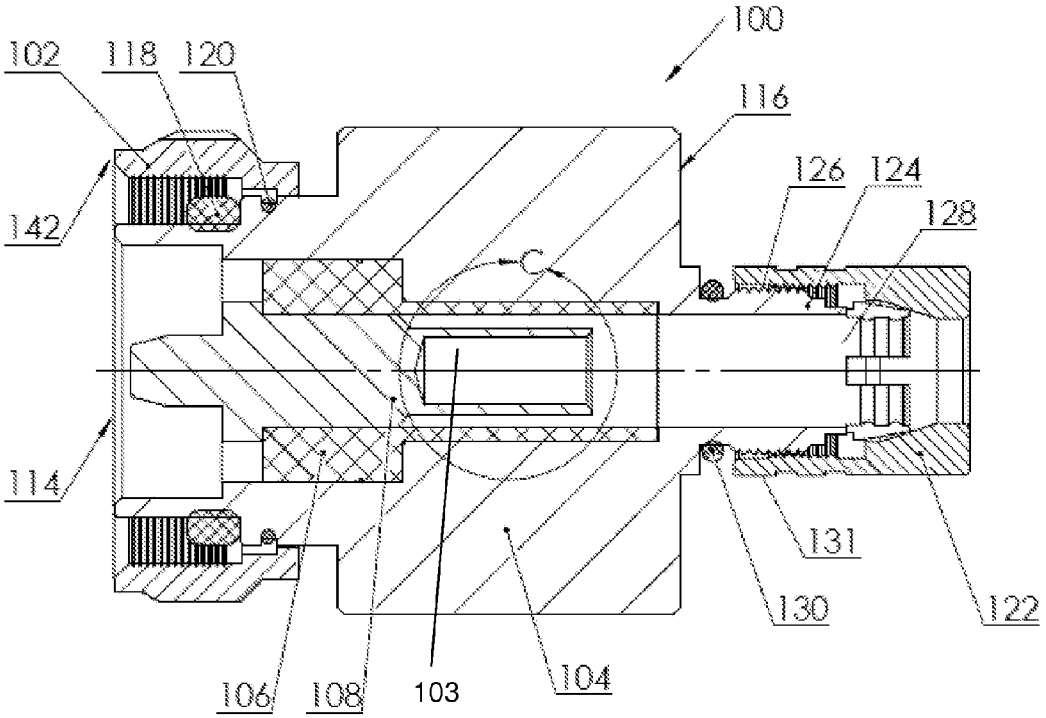
FIG. 2A is a cross-sectional side view of the electrical connector illustrated in FIG. 1, taken along line A-A.

As shown in FIG. 2A, the connector body 104, which houses the internal components of the electrical connector 100, may have two opposing ends 114 and 116. The first end 114 may be coupled to the sleeve 102. A primary seal ring 118 and an embedded spring 120 may be positioned between the first end 114 of the connector body 104 and the threaded sleeve 102 when the connector body 104 and threaded sleeve 102 are coupled, thereby preventing the sleeve 102 from pulling off of the connector body 104. The primary seal ring 118 may be of any type known to one skilled in the art, including, for example, an O-shaped ring.

According to one embodiment, the electrical connector 100 may also include a cylindrical extension 124. The extension 124 may extend from the second end 116 of the connector body 104. An outer surface of the extension 124 may have threads 126, such that it can be coupled to a primary cable clamp 122 that has internal threads. Specifically, an end 128 of the extension 124 may have a conical structure such that it fits within the primary cable clamp 122 and can be threaded therewith. The extension 124 may extend axially along the central axis of the connector body 104 and coaxially with the contact pin 108. In one embodiment, there may be an outer seal ring 130 positioned between an edge 131 of the primary cable clamp 122 and the second end 116 of the connector body 104.

Figure 2B:
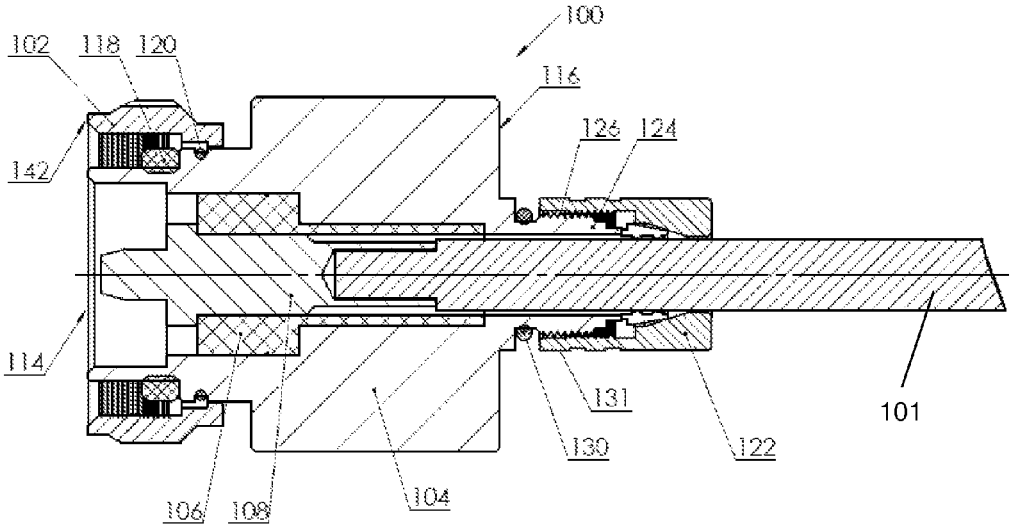
FIG. 2B is an enlarged cross-sectional side view of the electrical connector similar to FIG. 2A, showing a cable coupled with the connector.
Figure 2C:
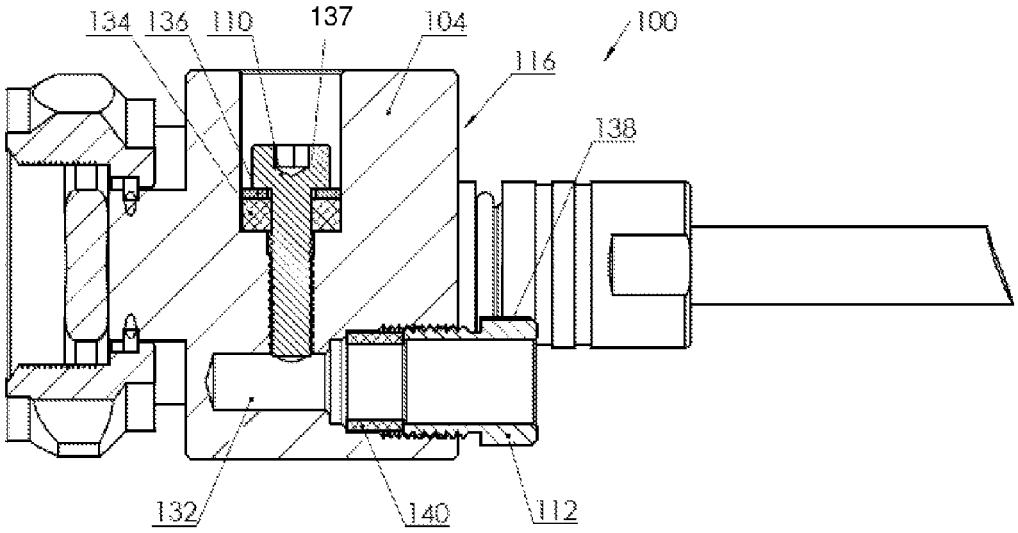
FIG. 2C is a cross-sectional side view of the electrical connector illustrated in FIG. 1, taken along line B-B.

As shown in FIG. 2C, the connector body 104 may have a blind hole 132 initiating at the second end 116, having an axis that is generally parallel with the axial center line of the contact pin 108. The blind hole 132 may be positioned within the connector body 104 just below and to one side of the extension 124. A fastener 110 may pass through the connector body 104 along an axis transverse to that of the blind hole 132, such that it communicates with the blind hole 132. A first washer 134 and a second washer 136 may be provided between a head 137 of the fastener 110 and the connector body 104. The first washer 134 and second washer 136 may be of any type known to one skilled in the art, including, for example, flat washers. The fastener 110 may be of any type known to one skilled in the art, including, for example, a socket hexagon screw.

At the second end 116 of the connector body 104, the secondary cable clamp 112 may be positioned within the blind hole 132, as seen in FIG. 2C. In one embodiment, the secondary cable clamp 112 has outer threads such that it can be coupled with the connector body 104 in the blind hole 132. The forepart of the cable clamp 112 may be provided with a flange 138, which abuts the second end 116 of the connector body 104 so as to ensure that the cable clamp 112 remains in position. According to one embodiment, a secondary seal ring 140 may be positioned between the cable clamp 112 and the connector body 104 within the blind hole 132.

Figure 2D:
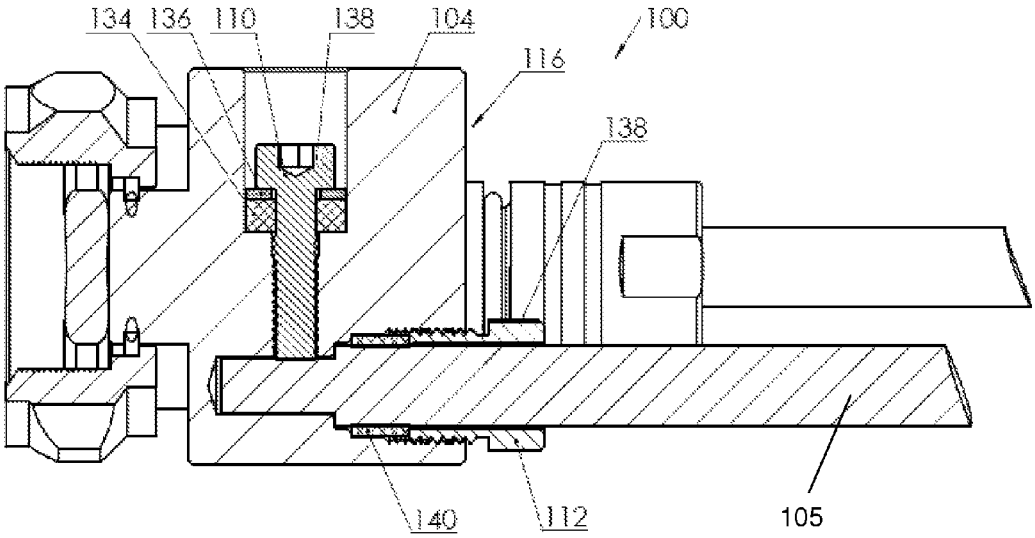
FIG. 2D is an enlarged cross-sectional side view of the electrical connector similar to FIG. 2C, showing a second cable coupled with the connector.

During installation, a first power cable 101 (FIG. 2B) is fed through the primary cable clamp 122 and the extension 124 and inserted into a tail end 103 of the contact pin 108 to form an internal conductor, as seen in FIG. 2B. A second power cable 105 is fed through the secondary cable clamp 112 and inserted into the blind hole 132 to form an external conductor, as seen in FIG. 2D. The fastener 110 may then be secured against a surface of the second power cable 105 (e.g., by screwing it toward the cable), such that it secures the second power cable 105 in place. Further, the primary cable clamp 122 and the secondary cable clamp 112 should be screwed tightly relative to the connector body 104 to secure the two power cables 101 and 105 in place.

The electrical connector 100 of the invention may be coupled to an existing primary antenna feeder connector 400. According to one embodiment, as shown in FIG. 4, the threaded sleeve 102 of the electrical connector 100 may engage threading 402 on a primary antenna feeder connector 400, such that the two connectors are coupled. In this way, power may be supplied to an antenna feeder via the primary antenna feeder connector 400.

Figure 3A:
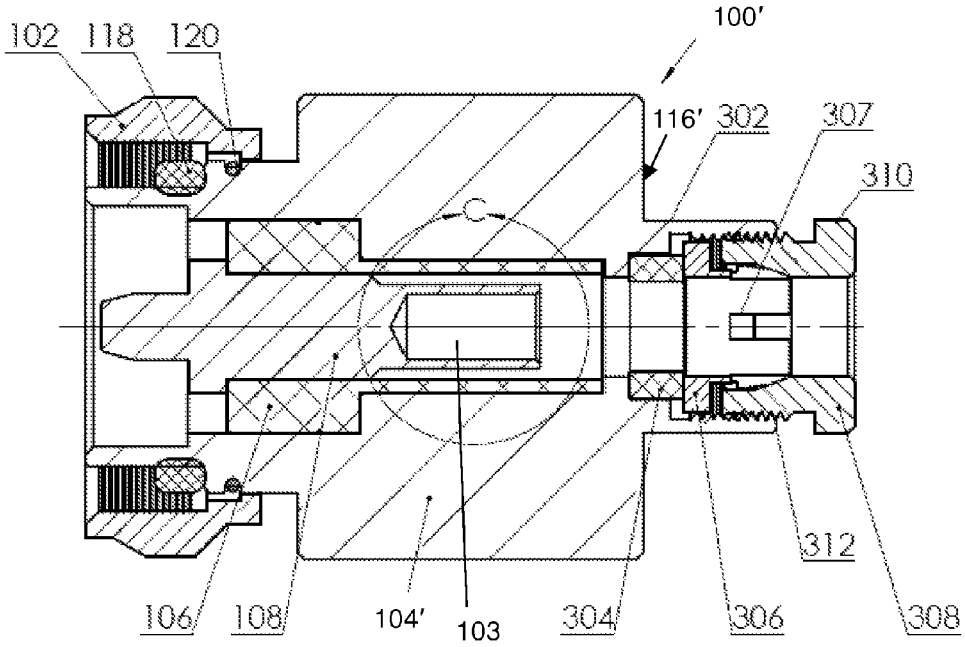
FIG. 3A is a cross-sectional side view similar to FIG. 2A of an electrical connector according to another exemplary embodiment of the present invention.
Figure 3B:
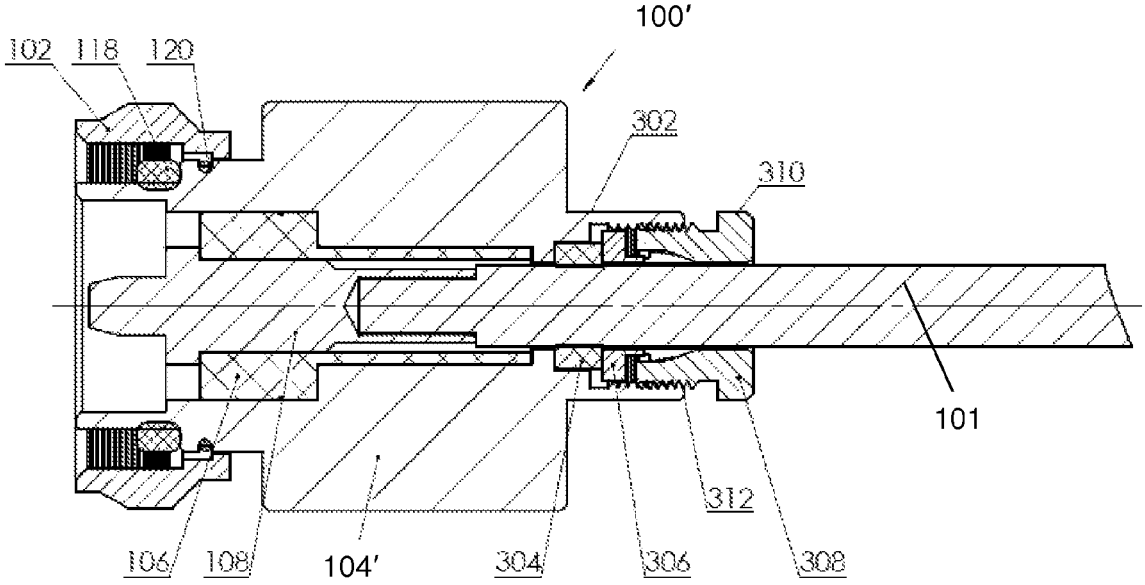
FIG. 3B is a cross-sectional side view of the electrical connector illustrated in FIG. 3A, showing a cable coupled therewith.
Figure 3C:
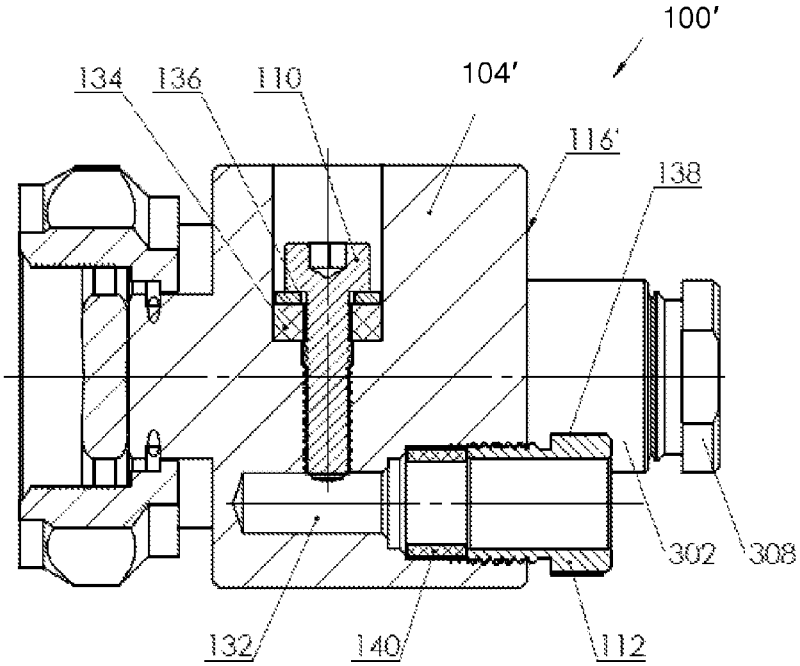
FIG. 3C is a cross-sectional side view similar to FIG. 2C of the electrical connector illustrated in FIG. 3A.

According to another embodiment of the invention, as shown in FIGS. 3A-3C, an electrical connector 100' may have a connector body 104' having a different structure at its second end 116' than connector body 104 of electrical connector 100.

The connector body 104' may have a hollow extension 302 extending from the second end 116'. An inner seal ring 304 and an internal core 306 may be positioned within the hollow extension 302. In one embodiment, the inner surface of the hollow extension 302 is threaded, such that it can couple to a primary cable clamp 308 that has external threading. The inner seal ring 304 and internal core 306 are positioned between the primary cable clamp 308 and the inside of the hollow extension 302. The internal core 306 may be provided with an axially extending fastening piece 307 that is positioned within the primary cable clamp 308 once coupled to the hollow extension 302. The internal core 306 uses the fastening piece 307 to secure the power cable 101 within the connector body 104'. The forepart of the primary cable clamp 308 may be provided with a flange 310, which may abut an edge 312 of the hollow extension 302 of the connector body 104', so as to ensure that the primary cable clamp 308 remains in position. The remaining components of electrical connector 100' are substantially the same as electrical connector 100, including the installation of the second cable via the secondary cable clamp 112 (FIG. 3C), and thus are not described in detail.

According to the second embodiment, during installation, the power cable 101 is fed through the primary cable clamp 308 and the internal core 306 and inserted into the tail end 103 of the contact pin 108 to form the internal conductor. The primary cable clamp 308 must be screwed tightly relative to the connector body 104' to lock the power cable in place. To form the external conductor, the second power cable is inserted into the secondary cable clamp 112 by the same method discussed above.

One preferred application of the present invention may be the IEC standard of the 7/16 coaxial connector. Aimed at reducing the cost, a primary antenna feeder may transmit power via the 7/16 connector in accordance with the present invention to connect and interface with a corresponding antenna jack of the antenna feeder. As a result, a direct current path is formed at the interface of the 7/16 electric connector of the present invention to connect the internal conductor with anode of direct current and connect the external conductor with cathode of the direct current.

While particular embodiments have been chosen to illustrate the invention, it will be understood by those skilled in the art that various changes and modifications can be made therein without departing from the scope of the invention as defined in the appended claims.

What is claimed is:

1. An electrical connector, comprising:

a threaded sleeve for mating with another electrical component;

a connector body having first and second ends and a central axis, the first end receiving the threaded sleeve and the second end having a blind hole extending through the connector body;

an insulator positioned within the connector body;

a contact pin positioned within the insulator and having an axial center line;

an extension extending from the second end of the connector body along its central axis, the extension extending coaxially with the contact pin and having a primary cable clamp;

a fastener positioned within the connector body; and a secondary cable clamp coupled to the second end of the connector body via the blind hole, wherein the blind hole is adjacent to the extension and the axis of the blind hole is substantially parallel with the axial center line of the contact pin, such that the fastener passes through the connector body such that at least a portion is receivable in the blind hole.

2. The electrical connector according to claim 1, wherein the extension is substantially cylindrical in shape and has a conical end having threading on an exterior surface thereof, the primary cable clamp being coupled to the conical end of the extension of the connector body.

3. The electrical connector according to claim 1, further comprising:

an outer seal ring positioned between the primary cable clamp and the second end of the connector body.

4. The electrical connector according to claim 1, further comprising a primary seal ring positioned between the first end of the connector body and the threaded sleeve; and an embedded spring positioned adjacent to the primary seal ring.

5. The electrical connector according to claim 1, further comprising a secondary seal ring positioned between the secondary cable clamp and the connector body within the blind hole.

6. The electrical connector according to claim 1, wherein the secondary cable clamp is provided with a flange.

7. The electrical connector according to claim 1, further comprising a first washer positioned between the fastener and the connector body.

8. The electrical connector according to claim 7, further comprising a second washer positioned between the fastener and the first washer.

9. The electrical connector according to claim 8, wherein the first washer and the second washer are flat washers.

10. The electrical connector according to claim 1, wherein the fastener is socket hexagon screw.

11. The electrical connector according to claim 1, wherein the secondary cable clamp has external threads.

12. An electric connector, comprising:

a threaded sleeve for mating with another electrical component;

a connector body having first and second ends, the first end receiving the threaded sleeve and the second end having a hollow extension extending therefrom, and a blind hole extending through the connector body, the blind hole being adjacent to the hollow extension;

an insulator positioned within the connector body;

a contact pin positioned within the insulator and having an axial center line;

a primary cable clamp coupled to the hollow extension of the connector body;

a fastening piece positioned within the primary cable clamp extending axially therewith;

a secondary cable clamp coupled to the second end of the connector body via the blind hole; and a fastener positioned within the connector body, wherein the axis of the blind hole is substantially parallel with the axial center line of the contact pin, such that the fastener passes through the connector body such that at least a portion is receivable in the blind hole.

13. The electrical connector according to claim 12, wherein the primary cable clamp has external threads and the hollow extension has internal threads.

14. The electrical connector according to claim 12, further comprising a primary seal ring positioned between the first end of the connector body and the threaded sleeve; and an embedded spring positioned adjacent to the primary seal ring.

15. The electrical connector according to claim 12, further comprising an inner seal ring positioned between the primary cable clamp and the hollow extension.

16. The electrical connector according to claim 12, further comprising a secondary seal ring positioned between the secondary cable clamp and the connector body within the blind hole.

17. The electric connector according to claim 12, wherein the primary cable clamp and secondary cable clamp are each provided with a flange.

18. The electrical connector according to claim 12, further comprising a first washer positioned between the fastener and the connector body.

19. The electrical connector according to claim 18, further comprising a second washer positioned between the fastener and the first washer.

20. The electrical connector according to claim 19, wherein the first washer and the second washer are flat washers.

21. The electrical connector according to claim 12, wherein the fastener is socket hexagon screw.

22. The electrical connector according to claim 12, wherein the secondary cable clamp has external threads.

23. An electrical connector comprising:

a threaded sleeve for mating with another electrical component;

a connector body having first and second ends and a central axis, the first end receiving the threaded sleeve and the second end having a blind hole extending through the connector body;

an insulator positioned within the connector body;

a contact pin positioned within the insulator and having an axial center line;

a primary cable clamp coupled to the second end of the connector body;

a fastener positioned within the connector body; and a secondary cable clamp coupled to the second end of the connector body via the blind hole, wherein the axis of the blind hole is substantially parallel with the axial center line of the contact pin, such that the fastener passes through the connector body such that at least a portion is receivable in the blind hole.

* * * * *